United States Patent [19]

Binns et al.

[11] 4,270,737

[45] Jun. 2, 1981

[54] SECURING FENCING MATERIAL TO POSTS

[75] Inventors: Julian R. H. Binns; Kenneth H. Grange, both of London, England

[73] Assignee: Binns Fencing Limited, London, England

[21] Appl. No.: 94,185

[22] Filed: Nov. 13, 1979

[30] Foreign Application Priority Data

Nov. 21, 1978 [GB] United Kingdom ..... 45437/78

[51] Int. Cl.[3] ..... B21F 27/00

[52] U.S. Cl. ..... 256/48; 256/32

[58] Field of Search ..... 256/48, 57, 47, 32, 256/73, 51

[56] References Cited

U.S. PATENT DOCUMENTS

| | | | |
|---|---|---|---|
| 752,854 | 2/1904 | Odell | 256/48 |
| 1,001,274 | 8/1911 | Johnson | 256/57 |
| 1,186,062 | 6/1916 | Anglemyer | 256/48 |
| 1,979,866 | 11/1934 | Chapman | 256/32 |
| 3,957,250 | 5/1976 | Murphy | 256/51 X |
| 4,132,390 | 1/1979 | Pfarr | 256/73 |
| 4,176,494 | 12/1979 | Boucher | 256/57 X |

FOREIGN PATENT DOCUMENTS

| | | | |
|---|---|---|---|
| 476376 | 3/1914 | France | 256/48 |

*Primary Examiner*—Andrew V. Kundrat

*Attorney, Agent, or Firm*—Berman, Aisenberg & Platt

[57] ABSTRACT

Fencing comprises fencing material secured to a post by means of a resiliently deformable clip which is inserted into an opening in the post and rotated through an angle to snap into a stable position in which it resists rotation and also resists being pulled out of the opening.

9 Claims, 5 Drawing Figures

SECURING FENCING MATERIAL TO POSTS

This invention relates to fencing in which fencing material, for example chain link fencing material, is secured to posts, the invention being particularly concerned with the means by which the fencing material is secured to the posts.

Chain link fencing material generally comprises a number of stiff wires extending in a zig-zag from top to bottom of the fence, with each wire being interlinked with two wires one on each side thereof to form a "diamond" pattern. Usually the zig-zag wires are secured to a top wire which runs along the top edge of the fencing material. At the bottom of the fencing material the lower ends of the zig-zag wires may be merely twisted together, or alternatively, a bottom wire similar to the top wire may be provided to which the zig-zag wires can be secured.

A problem exists in providing suitable means by which a zig-zag wire at the end of the fencing material can be readily and firmly secured to a fencing post at one or more places spaced-apart along the height of the post. An aim of the present invention is to provide suitable means for securing fencing material, especially chain link fencing material, to a fence post, although such means can be used for securing any kind of fencing material having links, loops or rings which can be engaged by clips.

With the above aim in view, the invention is directed to fencing in which chain link or other fencing material is secured to a post by means of a resiliently-deformable clip which is inserted into an opening in the post and rotated through an angle to snap into a stable position in which it resists rotation and also resists being pulled out of the opening.

An exemplary embodiment of fencing according to the invention will now be described with reference to the accompanying drawing, in which.

Fencing in accordance with the present invention comprises a plurality of posts, chain link or other fencing material extending between the posts, and one or more clips for securing the fencing material to at least one of the posts.

Figure 1:
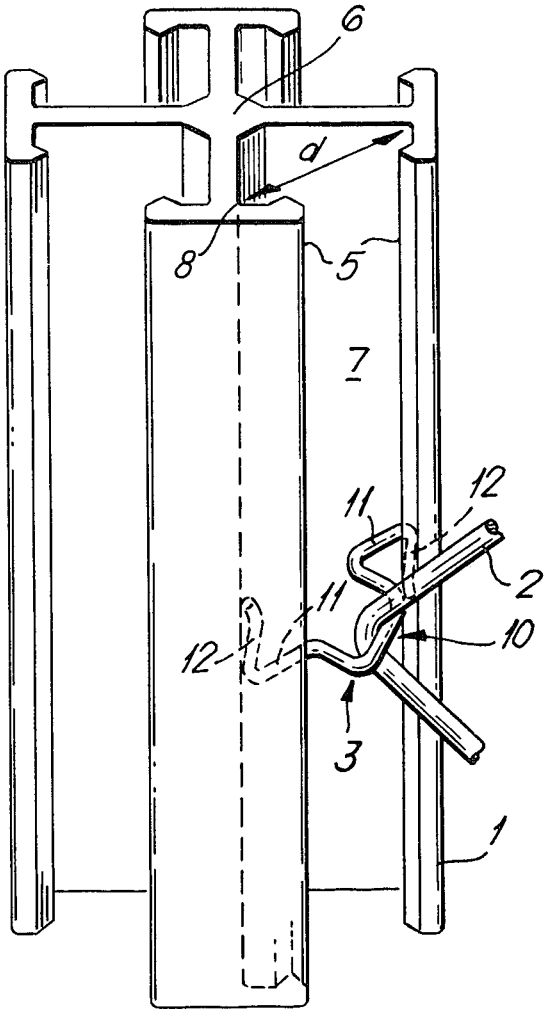
FIG. 1 is a perspective view of a loop or link of fencing material secured to a main post by a clip.
Figure 2:
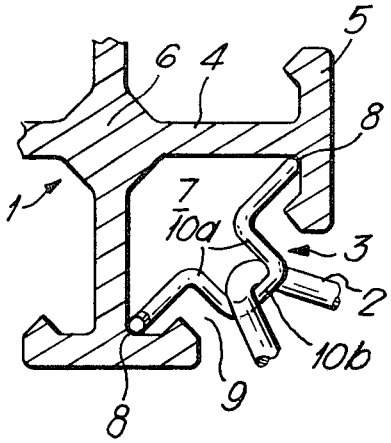
FIG. 2 is a top plan view of the fencing of FIG. 1.

FIGS. 1 and 2 show a main post 1 to which a chain link 2 of fencing material is secured by a retaining clip 3. The main post 1 is an aluminum extrusion, and as viewed in cross-section in FIG. 2, it comprises four T-shaped parts, each such part having a stem portion 4 and a bar portion 5. The bases of the stem portions 4 are connected together at a central part 6 of the post 1, and the stem portions 4 are spaced 90° apart from one another.

The post 1 has four open channels 7 extending the length thereof. Each channel has a maximum width d which is the distance between two opposite corner edges 8 of the channel, each corner edge 8 being formed where a stem portion 4 joins a bar portion 5. Each channel 7 narrows from its maximum width d towards the mouth 9 of the channel.

Fencing material, such as chain link fencing, will extend from the main post 1 towards another similar post (not shown). The chain link fencing material is not shown in detail, but it may comprise parallel top and bottom wires, and wires connected between the top and bottom wires and extending in a zig-zag with adjacent wires interlinked. The link 2 shown in FIGS. 1 and 2 is a part of one of the zig-zag wires which is at one end of the fencing material. The top and bottom wires will be connected to the main post 1 by a line wire tensioner which is not shown, but is described in our co-pending Patent Application No.

The link 2 is secured to the post 1 by means of a clip 3, and it will be understood that there may be several such clips 3 securing links or loops 2 of the end zig-zag wire to the post 1. As viewed in FIG. 3, each clip is generally 'S' shaped, comprising a central portion 10, two connecting arms 11 which extend from opposite ends of the central portion in opposite but generally parallel directions, and two end arms 12 which extend one from each of the connecting arms 11, the two end arms 12 being generally parallel to each other.

Figure 3:
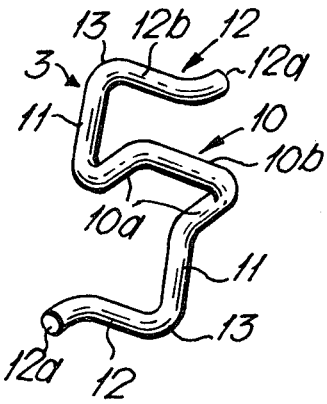
FIG. 3 is a view of the clip shown in FIGS. 1 and 2.

The central portion 10 of the clip 3 could merely be a straight arm extending direct between the two connecting arms 11, but it is preferable to make the central portion 10 to be U-shaped, comprising legs 10*a* connected one to each connecting arm, and a bridging part 10*b* connecting the legs 10*a* together. As best seen in FIG. 3, the clip 3 has rounded corners 13 formed where the connecting arms 11 join end regions 12*b* of end arms 12, and the end arms 12 are bent so as to be formed with outwardly bent free end regions 12*a*. The clip 3 is made of stiff but resilient wire bent to the desired shape.

The way in which the clip 3 is used to secure the link 2 to the post 1 will now be described. The clip 3 is manoeuvered into an upright position (FIG. 3) with a link or loop 2 of the fencing trapped in the U-shaped central portion 10 of the clip. The clip 3, still in its upright position, is then pushed into the channel 7 through the mouth 9 thereof. The clip 3 is then rotated anticlockwise from its position shown in FIG. 3 towards its securing position shown in FIGS. 1 and 2. As the clip 3 is rotated the smoothly rounded corners 13 will ride against the corner edges 8 of the channel, the relative dimensions of the clip and channel being such that the clip will be distorted as it is turned. As the clip is being turned, it will snap into its securing position, FIGS. 1 and 2, this position being a very stable position of the clip from which it cannot be easily moved. As best shown in FIG. 1, the end arms 12 of the clip 3 engage the corner edge of the channel 7 by way of their end regions 12*a* and 12*b*, there being a dip 12*c* between the end regions 12*a* and 12*b*. The fact that there is point contact rather than line contact between the clip 3 and the corner edges 8 of the post enhances the rotational stability of the clip when in its retaining position, in which position the clip is resiliently deformed. Any tension in the chain link fence will tend to pull the clip out of the channel 7 via the open mouth 9, but the mouth 9 is much narrower than the width d, and the clip 3 is made of very stiff wire so that the clip will withstand very high tension in the fence.

It is anticipated that the stiffness of the wire clip 3 will render it difficult or impossible for the clip to be rotated by hand, but the central portion 10 of the clip is shaped so that it can be firmly gripped by a pair of pliers by means of which the clip can be rotated.

The arrangement described above can be modified in several ways. For example, the cross-sectional shape of the main post could be changed, provided that there is a firm surface for the ends of the clip to seat on and provided that there is a narrowed portion of the channel adjacent the clip to prevent it being pulled out of place by tension in the fencing material. The fencing material itself could be of any design, provided that links, loops, or rings of the fencing are provided for the clip to engage. The clip 3 need not be of the 'S' shape illustrated in FIG. 3, although the clip must be shaped to be stable when in its retaining position.

Figure 4:
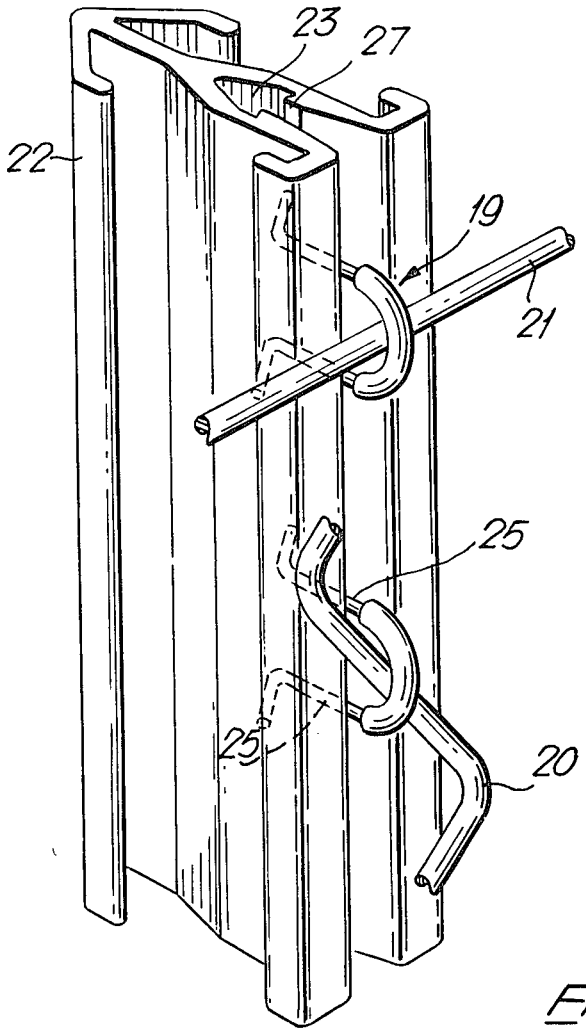
FIG. 4 is a view similar to FIG. 1 but showing how a top wire and a zig-zag wire of chain link fencing are secured to a line post.
Figure 5:
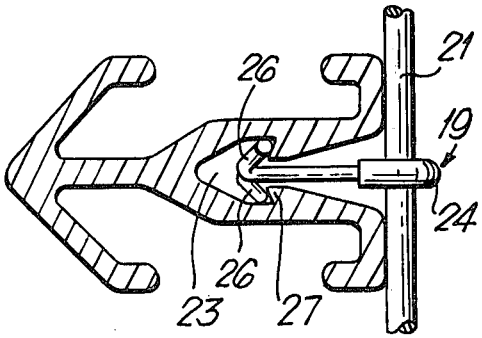
FIG. 5 is a top plan view of the line post of FIG. 4.

FIGS. 4 and 5 show how a clip 19 is used to secure a zig-zag wire 20 and a line wire 21 to an extruded aluminium line post 22 having a channel 23 which has a cross-sectional shape similar to an arrow head. The clip 19 is generally U-shaped, comprising a base 24 covered by a plastics material sleeve and two arms 25. The ends 26 of the arms 25 are bent outwardly away from one another. The ends 26 are also bent out of the plane of the 'U', the ends 26 lying on opposite sides of such planes.

As is apparent from the drawings, each clip 19 is placed around a line wire 12 or a zig-zag wire 20, and is then forced into the channel 23 from the front of the post. The ends 26 of the clip 19 will be deformed towards the plane of the 'U' as the clip is forced into the channel, until the ends 26 reach the wider inner part of the channel, whereupon the ends 26 will spring outwardly to engage behind shoulders 27 to prevent the clip from being pulled out of the channel. The sleeve on the base 24 of the clip should be made of a resilient plastics material which will deform to enable the clip to be used with various diameters of line wires and zig-zag wires.

We claim:

1. Fencing comprising a fence post having an opening, fencing material, and securing means securing the fencing material to the post, the said securing means comprising a resiliently-deformable clip which is inserted into said opening in the post and rotated through an angle to snap into a stable position in which it resists rotation and also resists being pulled out of the opening, said clip being generally 'S'-shaped and comprising (a) a central portion, (b) two connecting arms which extend from opposite ends of the central portion in opposite but generally parallel directions, and (c) two end arms which extend one from each of the connecting arms, the two end arms being generally parallel to each other.

2. Fencing as claimed in claim 1, in which the said central portion of the clip is U-shaped and comprises legs connected one to each connecting arm, and a bridging part connecting the legs together.

3. Fencing as claimed in claim 2, in which the said connecting arms and end arms of the clip lie generally in a first plane, and in which the said U-shaped central portion of the clip lies generally in a second plane which is disposed generally at a right angle to the first plane.

4. Fencing as claimed in claim 1, in which the clip has rounded corners formed where the connecting arms join end regions of the end arms.

5. Fencing as claimed in claim 1, in which the clip, when in its stable position, is resiliently deformed, and engages the post with point contact rather than line contact, said point contact being between two opposite end regions of each arm and the post.

6. Fencing as claimed in claim 1, in which the clip is made of stiff but resilient wire bent to the desired shape.

7. Fencing as claimed in claim 1, in which said opening in the fence post comprises a channel having a wider portion accessible by way of a restricted mouth, said post being provided with two corner edges disposed opposite one another and facing one another within said channel and extending longitudinally of the post, the clip being made of a stiff but resilient wire and having a maximum dimension within the channel greater than the spacing between said corner edges whereby, during rotation of the clip, said clip engages the said opposite corner edges and is caused to be resiliently deformed, the clip, when in its said stable position, also engaging said corner edges and being resiliently deformed.

8. Fencing comprising a fence post having an opening, and a clip for securing fencing material to the post, said fence post opening comprising a channel having a wider portion accessible by way of a restricted mouth, said post being provided with two corner edges disposed opposite one another and facing one another within said channel and extending longitudinally of the post, the clip being made of a stiff but resilient wire and being insertable into the channedl to be rotated through an angle to snap into a stable position in which it resists rotation and also resists being pulled out of the opening, the clip having maximum dimension within the channel greater than the spacing between said corner edges whereby, during rotation of the clip, the clip engages the said opposite corner edges and is caused to be resiliently deformed, the clip, when in its said stable position, engaging said corner edges and being resiliently deformed.

9. Fencing comprising a fence post, an opening in said fence post, fencing material, and securing means securing the fencing material to the post, wherein the improvement comprises the said securing means being a resiliently deformable generally U-shaped wire clip, said clip comprising two generally parallel arms having free end regions, said free end regions being bent outwardly away from one another and also being bent out of a plane in which the said arms of the 'U' lie to be disposed on opposite sides of said plane, said opening in the post having a mouth, a portion of wider dimension than said mouth, and shoulders disposed inwardly of said mouth adjacent said portion of wider dimension, the size of said mouth of the opening and the angle by which said free end regions are bent out of said plane being such that when the clip is inserted into said opening via said mouth with said free end regions of the clip leading, said free end regions are bent back somewhat towards the plane of the 'U' until they enter the said wider portion of the opening whereupon they snap into place behind said shoulders to prevent withdrawal of the clip.

* * * * *